US005664634A

United States Patent [19]

McCracken

[11] Patent Number: 5,664,634

[45] Date of Patent: Sep. 9, 1997

[54] POWER TOOL

[75] Inventor: Robert E. McCracken, Tucson, Ariz.

[73] Assignee: Waxing Corporation of America, Inc., Elmhurst, Ill.

[21] Appl. No.: 547,033

[22] Filed: Oct. 23, 1995

[51] Int. Cl.[6] ..... E02D 7/02

[52] U.S. Cl. ..... 173/48; 173/205; 15/22.1; 15/53.1; 310/50

[58] Field of Search ..... 173/48, 109, 178, 173/205, 217; 15/22.1, 21.1, 22.2, 38, 53.1, 53.2; 310/47, 50

[56] References Cited

U.S. PATENT DOCUMENTS

| | | | |
|---|---|---|---|
| Re. 35,372 | 11/1996 | Houben et al. | 173/109 |
| D. 111,005 | 8/1938 | Sperry . | |
| D. 140,197 | 1/1945 | Runstrom | D54/14 |
| D. 301,496 | 6/1989 | Yonesawa et al. | D8/68 |
| D. 325,857 | 5/1992 | Hasegawa et al. | D8/61 |
| 2,135,861 | 11/1938 | Thompson | 96/33 |
| 3,379,906 | 4/1968 | Spohr | 310/50 |
| 3,394,277 | 7/1968 | Satkunas et al. | 310/80 |
| 3,489,936 | 1/1970 | Boyles | 310/47 |
| 3,524,088 | 8/1970 | Ryckman | 310/50 |
| 3,530,319 | 9/1970 | Larkin | 310/50 |
| 3,546,501 | 12/1970 | Kircher | 310/50 |
| 3,562,566 | 2/1971 | Kircher | 310/80 |
| 3,633,931 | 1/1972 | Bilz | 279/75 |
| 3,658,351 | 4/1972 | Benjamin et al. | 271/1 B |
| 3,661,018 | 5/1972 | Keefer et al. | 74/22 R |
| 3,674,281 | 7/1972 | Hedrick | 279/30 |
| 3,684,302 | 8/1972 | Herman | 279/75 |
| 3,699,825 | 10/1972 | Misuraca | 74/527 |
| 3,699,952 | 10/1972 | Waters et al. | 128/24.2 |
| 3,735,993 | 5/1973 | Seibert | 279/1 B |
| 3,788,658 | 1/1974 | Benjamin et al. | 279/75 |
| 3,929,343 | 12/1975 | Wanner et al. | 279/1 B |
| 3,940,580 | 2/1976 | Williams et al. | 200/61.85 |
| 4,071,722 | 1/1978 | Hart | 200/50 A |
| 4,355,977 | 10/1982 | Ota et al. | 433/131 |
| 4,397,055 | 8/1983 | Cuchiara | 15/22 R |
| 4,537,264 | 8/1985 | Schmid et al. | 173/48 |

(List continued on next page.)

FOREIGN PATENT DOCUMENTS

WO93/11910 6/1993 WIPO .

OTHER PUBLICATIONS

United States Design Patent Application Serial No. 29/045,507, filed on Oct. 23, 1995, entitled "Power Tool".

*Primary Examiner*—Scott A. Smith

*Attorney, Agent, or Firm*—Fitch, Even, Tabin & Flannery

[57] ABSTRACT

A power tool is provided and includes a housing having a first longitudinal axis extending therein. An output shaft is mounted in the housing along the longitudinal axis operably connected to the working element. A motor in the housing is provided for driving the output shaft. A transmission system has cooperating portions which are movable between (1) a first state wherein the cooperating portions are disengaged from each other allowing the output shaft to reciprocate, and (2) a second state wherein the cooperating portions are engaged with each other causing the output shaft to rotate. A wobble driver is mounted to the output shaft with the wobble driver having (1) a first mode wherein the wobble driver is in driving relation to the output shaft and is capable of reciprocating with the output shaft along the first longitudinal axis, and (2) a second mode when the wobble driver is in non-driving relation to the output shaft. An actuator cooperates with the wobble driver and one of the transmission system cooperating portions. The actuator is selectively movable between (1) a first position wherein the transmission cooperating portions are in their first disengaged state and the wobble driver is in its first driving mode relative to the output shaft with the wobble driver reciprocating with the output shaft along the first longitudinal axis to reciprocate the working element, and (2) a second position wherein the transmission system cooperating portions are in their engaged state and the wobble driver is in its second non-driving mode relative to the output shaft with the output shaft rotating to rotate the working element.

27 Claims, 5 Drawing Sheets

U.S. PATENT DOCUMENTS

| | | | |
|---|---|---|---|
| 4,603,448 | 8/1986 | Middleton et al. | 15/22 R |
| 4,612,999 | 9/1986 | Bergler | 173/109 |
| 4,629,375 | 12/1986 | Lieser | 408/239 R |
| 4,692,073 | 9/1987 | Martindell | 408/239 A |
| 4,710,995 | 12/1987 | Joyashiki et al. | 15/22 R |
| 4,742,190 | 5/1988 | Jacquet | 200/50 A |
| 4,756,202 | 7/1988 | Kawamoto | 74/23 |
| 4,772,765 | 9/1988 | Markle et al. | 200/1 V |
| 4,849,587 | 7/1989 | Bacon | 200/61.85 |
| 4,900,202 | 2/1990 | Wienhold | 408/240 |
| 5,013,194 | 5/1991 | Wienhold | 408/240 |
| 5,019,676 | 5/1991 | Heckenkamp | 200/50 A |
| 5,069,082 | 12/1991 | Seng et al. | 74/523 |
| 5,159,986 | 11/1992 | Höser | 173/48 |
| 5,188,378 | 2/1993 | Erienkeuser | 279/22 |
| 5,191,968 | 3/1993 | McCurry | 200/43.11 |
| 5,310,259 | 5/1994 | Wanat | 366/349 |
| 5,398,946 | 3/1995 | Quiring | 279/30 |
| 5,423,102 | 6/1995 | Madison | 15/22.2 |

POWER TOOL

FIELD OF THE INVENTION

This invention relates to power tools and, more particularly, to a power tool having a transmission which can drive a working element in either rotary or reciprocating motions.

BACKGROUND OF THE INVENTION

There is a need for a hand-held power tool that has the capability to clean surfaces, such as by brushing and buffing, which may otherwise be difficult to effectively clean, such as on automobiles, particularly in their interiors. Automobile owners generally clean the exterior surfaces of their cars on a fairly regular basis either themselves or by running their car through an automatic carwash such as at gasoline stations. These automatic carwashes uetilize high pressure jets of cleaning solution sprayed at the cars as they are run through the carwash and have rotating apparatuses carrying rag-type cleaning elements and/or brush bristles which are moved to a position adjacent the car so as to contact the car's exterior surface as they are rotated. While these car-washes are quick, they are generally no substitute for a manual detailing of the car's surfaces, especially those surfaces which can be buffed to a high shine such as chrome and other metallic surfaces and those surfaces which are hard to access such a between parts. Automated carwashes typically do not have the capacity for such specified cleaning and can not approach the cleaning job obtained through a manual detailing where a person can apply precise pressure to difficult-to-clean spots, such as where there is dirt build-up and can buff specific surfaces until they are shined sufficiently.

With respect to the car's interior surfaces, particularly those that are difficult to access, such as the surfaces on and around the doors, dashboard and steering column, these surfaces are subject to cleaning on a much more infrequent basis than the car's exterior and are generally only cleaned when a car is taken in to be detailed at a full-service carwash after an automated washing of the car's exterior. As molding techniques for producing car parts have become more advanced, these interior parts have correspondingly taken on a wider variety of shapes and configurations which can make them more difficult to access and clean. Because of the lack of regular cleaning, these surfaces can get fairly dirty with grime and dust which builds up over lengthy periods of time. In order to clean these surfaces, workers at full-service carwashes generally use a wide variety of different types of cleaning solutions applied to the surfaces designed to cut through the dirt buildup thereon with the surfaces being wiped down by brushes, rags and the like. As with the exterior detailing, to ensure a good cleaning job for these surfaces, the rags or other cleaning elements must be wiped against the surface with a certain amount of pressure so as to remove the dirt buildup thereon. Where the surfaces are difficult to access, it is also difficult for a worker to obtain the proper leverage to apply the pressure required to ensure a thorough cleaning of the surface. Oftentimes, the workers will open the car door when cleaning the car's interior surfaces and position themselves so their legs are on the ground outside the car while they clean the underneath surfaces on and near the dashboard and steering column areas in the car so as to be able to gain the leverage to exert the pressure required on these surfaces for removing the accumulated dirt thereon. As carwashes can be high volume facilities where workers are driving cars to various locations thereabout, the requirement that workers position themselves partially outside the car to clean car interior surfaces can present a potentially hazardous situation.

As is apparent from the above, cleaning and detailing the surfaces of a car is a difficult and laborious task which may explain why car owners do not often perform this task themselves, or at least on a more regular basis as with each washing of the car exterior. It also explains the presence of such detailing facilities as car owners would rather pay someone else the money to detail their car rather than exert the time and effort required if they were to do it themselves. Such non-automated detailing can be fairly expensive, particularly if one desires to keep their car detailed on a regular basis. Thus, there is a need for a hand-held power tool which can be used to clean and buff surfaces, such as on a car. In addition, it is desirable that the power tool have a working element which can be rotated or reciprocated against the surface to be cleaned so as to provide the tool with greater flexibility in cleaning surfaces having different orientations and various configurations and which otherwise would be difficult to effectively clean either manually or in an automatic carwash. Such a power tool should have a sturdy, heavy duty transmission for generating rotary and reciprocating action of the cleaning element as the cleaning element will often be applied with some pressure by the worker using the tool against the surface being cleaned. The tool should be ergonomically designed so that it can be gripped at a variety of locations along its housing to accommodate the various surfaces it must reach and clean while also allowing an operator to exert the appropriate amount of control and pressure on the cleaning element. The tool should also have a mechanism which prevents a user from shifting the tool from its rotating mode to its reciprocating mode while the tool is being operated to avoid shock loads on the gears and shafting of the transmission system and stripping of gear teeth. Finally, the power tool should be capable of being used with a wide variety of cleaning elements which can be easily and quickly interchanged with each other for use with the tool.

SUMMARY OF THE INVENTION

In accordance with the present invention, a power tool having a working element capable of rotating or reciprocating is provided which overcomes the aforementioned problems and meets the above-mentioned needs in a novel and simple manner.

In one form of the invention, the power tool includes a housing having a first longitudinal axis extending therein. An output shaft is mounted in the housing along the longitudinal axis operably connected to the working element. A motor in the housing is provided for driving the output shaft. A transmission system has cooperating portions which are movable between (1) a first state wherein the cooperating portions are disengaged from each other allowing the output shaft to reciprocate, and (2) a second state wherein the cooperating portions are engaged with each other causing the output shaft to rotate. A wobble driver is mounted to the output shaft with the wobble driver having (1) a first mode wherein the wobble driver is in driving relation to the output shaft and is capable of reciprocating with the output shaft along the first longitudinal axis, and (2) a second mode when the wobble driver is in non-driving relation to the output shaft. An actuator cooperates with the wobble driver and one of the transmission system cooperating portions. The actuator is selectively movable between (1) a first position wherein the transmission cooperating portions are in their first disengaged state and the wobble driver is in its first driving mode relative to the output shaft with the wobble driver reciprocating with the output shaft along the first longitudinal axis to reciprocate the working element, and (2) a second position wherein the transmission system cooperating portions are in their engaged state and the wobble driver is in its second non-driving mode relative to the output shaft with the output shaft rotating to rotate the working element. The above power tool allows an operator to select between a rotary mode of operation and a reciprocating mode of operation to drive the working element accordingly against a surface to be cleaned providing the operator with flexibility in deciding which cleaning action is best for a particular surface.

Preferably, the wobble driver is mounted to the output shaft to be independently rotatable relative thereto. The wobble driver can include a driven gear for causing the member to freely rotate about the output shaft and a cam member inclined relative to the first longitudinal axis. The housing and actuator can have portions thereon which cooperate to form a channel for the cam member with the actuator in its first position to cause the wobble driver to reciprocate as the cam member is rotated in the channel and engages the housing and actuator portions. By forming a channel for the cam member between two portions fixed in predetermined positions in the housing, a sturdy transmission is provided for the detailer herein.

The cam member can have contoured surfaces for rolling contact along the housing and actuator portions with the actuator in its first position to smoothly reciprocate the wobble driver. A smooth reciprocating action is desirable as otherwise the cleaning element, when positioned in engagement with a surface to be cleaned, may skip or jump along the surface.

The transmission system can include a secondary drive shaft in the housing driven by the motor and including an elongate second driving gear which drives the wobble driven gear causing the wobble driver to freely rotate about the output shaft. The wobble driven gear reciprocates along the elongate second driving gear with the actuator in its first position and is retained in a substantially fixed axial position relative to the second driving gear by the actuator portion with the actuator in its second position so as to only rotate about the output shaft in the fixed axial position.

In one form, the housing includes a control for the actuator and a switch selectively movable between an "on" position with the motor energized to drive the output shaft and an "off" with the motor deenergized. The switch locks the control to maintain the actuator in one of its first and second positions when the switch is in the "on" position. In this manner, the switch prevents the control from being operated while the motor is running and the transmission is in either the rotary or reciprocating mode of operation as any attempt to shift modes could strip the transmission gears and generate unnecessary and potentially damaging loads on the transmission system.

Preferably, the transmission includes a secondary drive shaft in the housing driven by the motor. The one transmission cooperating portion is a driven gear on the output shaft and the other transmission cooperating portion is a first driving gear on the secondary drive shaft. The output shaft driven gear can be slidably mounted on the output shaft. The actuator can be provided with a gear capturing portion which captures the output shaft driven gear for sliding movement along the output shaft as the actuator is moved from one of its first and second positions to the other of its first and second positions.

The wobble driver can include an elongate second driving gear having a length and for driving the wobble driven gear causing the wobble driven gear to reciprocate along the length of the second driving gear with the actuator in its first position.

In one form, the housing has a forward portion through which the first longitudinal axis extends. The forward housing portion contains the transmission system. The housing has a rearward grippable portion having a second longitudinal axis extending therethrough with the first longitudinal axis intersecting the second longitudinal axis to define an included obtuse angle therebetween. The forward portion can include a gripping surface thereon so as to provide the power tool with a pencil grip to allow an operator to control the power tool thereat during tool operation. The rearward portion can include a battery pack removably mounted therein for supplying power to the motor.

In one form, the tool is in combination with a pilot shaft mounting the working element and having a circumferential groove formed therein. A collet is provided having a main annular portion and a forward flared portion. An inner sleeve mounts the output shaft and removably mounts the grooved pilot shaft and has a radial bore aligned with the pilot shaft groove when the pilot shaft is secured in the sleeve. The collet main annular portion is sized to be slidable along the inner sleeve with the sleeve in the collet. A detent ball is disposed between the collet and sleeve. The collet is spring biased to a predetermined position outside the housing with the collet annular portion pushing the detent ball to extend at least partially through the radial bore and into the circumferential groove to secure the pilot shaft in the sleeve.

The collet can be pushed against the spring bias from the predetermined position towards the housing to move the collet flared portion sufficiently rearwardly into alignment with the radial bore allowing the detent ball to move out of the circumferential groove into a pocket formed between the sleeve forward end and the collet flared portion to thereby allow the pilot shaft to be removed from the sleeve.

In another form of the invention, a power tool having a working element capable of rotating or reciprocating is provided including a motor producing rotary input power to drive the output shaft for one of rotation and reciprocation. A wobble driver is mounted on the output shaft in a fixed, axial position relative thereto to drive the output shaft for reciprocation therewith and to freely rotate relative thereto. The wobble driver includes a rear driven gear to freely rotate the wobble driver about the output shaft and a forward cam member inclined relative to the longitudinal axis to convert the rotation of the wobble driver about the output shaft to reciprocation of the wobble driver which drives the output shaft therewith along the longitudinal axis. An actuator cooperates with the wobble driver to cause the rotary input power of the motor to one of (1) drive the output shaft for rotation to rotate the working element and (2) drive the wobble driver for reciprocation with the output shaft along the longitudinal axis to reciprocate the working element. A cam engaging portion in the housing and an actuator portion can be selectively movable relative to each other between (1) a first position adjacent to each other to cooperate to form a channel such that the wobble cam member engages the portions as the wobble driver rotates causing the wobble driver and output shaft to reciprocate along the longitudinal axis and (2) a second position spaced further from each other than when in their adjacent first position to position the actuator portion adjacent the rear driven gear preventing the wobble driver from reciprocating along the longitudinal axis.

In one form, the actuator is selectively movable and the housing portion is a flange member fixed to the housing. The actuator is selectively movable between (1) a forward position with the portions in their first adjacent position and (2) a rearward position with the portions in their second, spaced apart position. The output shaft can include a driven gear slidably mounted thereon and the actuator can have a gear capturing portion which captures the output shaft driven gear for sliding movement along the output shaft as the actuator is moved from one of its forward and rearward positions to the other of its forward and rearward positions.

In one form, the output shaft and the wobble driver are both driven for independent rotation relative to each other by the motor rotary input power with the actuator in its second position.

In one form, the motor has a primary drive shaft and the motor input rotary power is transmitted to the output shaft by a secondary shaft geared to the primary drive shaft. The secondary shaft can include first and second driving gears with the first gear being selectively movable into and out of driving relation relative to the output shaft and the second driving gear driving the rear driven gear to rotate the wobble driver about the output shaft when the first gear is both in driving relation with the output shaft and out of driving relation with the output shaft. The output shaft can have a driven gear slidably mounted thereon with the actuator sliding the output shaft driven gear along the longitudinal axis as it is moved between its first and second positions. Thus, with the actuator in its first position, the output shaft drive gear is disengaged from the secondary shaft first driving gear, and with the actuator in its second position, the output shaft driven gear is engaged with the secondary shaft first driving gear to rotate the output shaft.

In another form of the invention, a power tool having a working element selectively movable between a rotary mode of operation and a reciprocating mode of operation is provided. A motor includes a primary drive shaft and a driving gear on the drive shaft. A secondary shaft is mounted in the housing and has a plurality of gears with a first one of the secondary shaft gears cooperating with the primary shaft driving gear for rotary driving of the secondary shaft. A wobble driver is provided having a collar portion and a gear portion with the wobble driver being mounted on the output shaft to freely rotate therearound and to drive the output shaft along the longitudinal axis. A driven gear is mounted on the output shaft and is selectively movable on the shaft along the longitudinal axis to (1) an engaged position where the driven gear cooperates with a second one of the secondary shaft gears for driving the output shaft for rotation with the power tool in a rotary mode of operation, and (2) a disengaged position where a third one of the secondary shaft gears cooperates with the wobble gear portion to drive the output shaft for reciprocation with the power tool in a reciprocating mode of operation, the third secondary shaft gear causing rotation of the collar about the output shaft with the driven gear in either one of the engaged and disengaged positions. An actuating mechanism is provided to selectively allow an operator to change the power tool from one of the rotary and reciprocating modes of operation to the other of the rotary and reciprocating modes of operation.

The actuating mechanism can include a control mounted on the housing and an actuator mounted in the housing to cooperate with the output shaft driven gear with the control selectively moving the actuator to move the driven gear between its engaged and disengaged positions. The actuator can have a rear gear capturing portion to capture the output shaft driven gear for movement therewith and a forward boss which is positioned adjacent the wobble gear portion with the output shaft driven gear in its engaged position and adjacent the cam member with the output shaft driven gear in its disengaged position.

In another form of the present invention, a power tool having a working element for cleaning and buffing is provided. The power tool includes an output shaft having a first state wherein the shaft and working element undergo a first motion and a second state wherein the shaft and connected working element undergo a second motion, distinct from the first motion. A transmission between the motor and output shaft transmits the rotary input power of the motor to the output shaft to drive the output shaft in either one of its first and second states. A control is mounted on the housing and is selectively movable between first and second positions, such that with the control in the first position, the transmission causes the output shaft to be driven in its first state and with the control in the second position, the transmission system causes the output shaft to be driven in its second state. A motor switch is mounted on the housing selectively movable between an "off" position with the motor deenergized and an "on" position with the motor energized to drive the output shaft in one of its first second states. With switch in the "on" position, the switch cooperates to lock the control in one of its first and second position against selected movement to other of its first and second positions. In this manner, the interlocking switch and control arrangement prevents the control from switching the transmission system while the motor is running, to avoid damaging the transmission system.

Preferably, the output shaft undergoes reciprocating motion in its first state and rotating motion in its second state.

The motor can have a first low speed and a second high speed. The switch can cooperate to lock the control with the motor being driven at either one of its first and second speeds.

The switch and control are preferably mounted adjacent each other on the housing. The switch can include a seat formed therein and the control can include a raised gripping portion thereof, such that with the switch in the motor "on" position, the gripping portion is at least partially disposed in the switch seat to prevent movement of the control between its first and second positions. The control can be in the form of a circular knob and with the switch in its motor "off" position, the gripping portion can be turned through 180° to rotate the knob for moving the control from one of its first and second positions to the other of its first and second positions. In either of the first and second positions, the gripping portion is aligned with the seat such that the seat can be moved to capture the gripping portion therein when the switch is moved to its motor "on" position.

DETAILED DESCRIPTION OF THE PREFERRED EMBODIMENT

Figure 1:
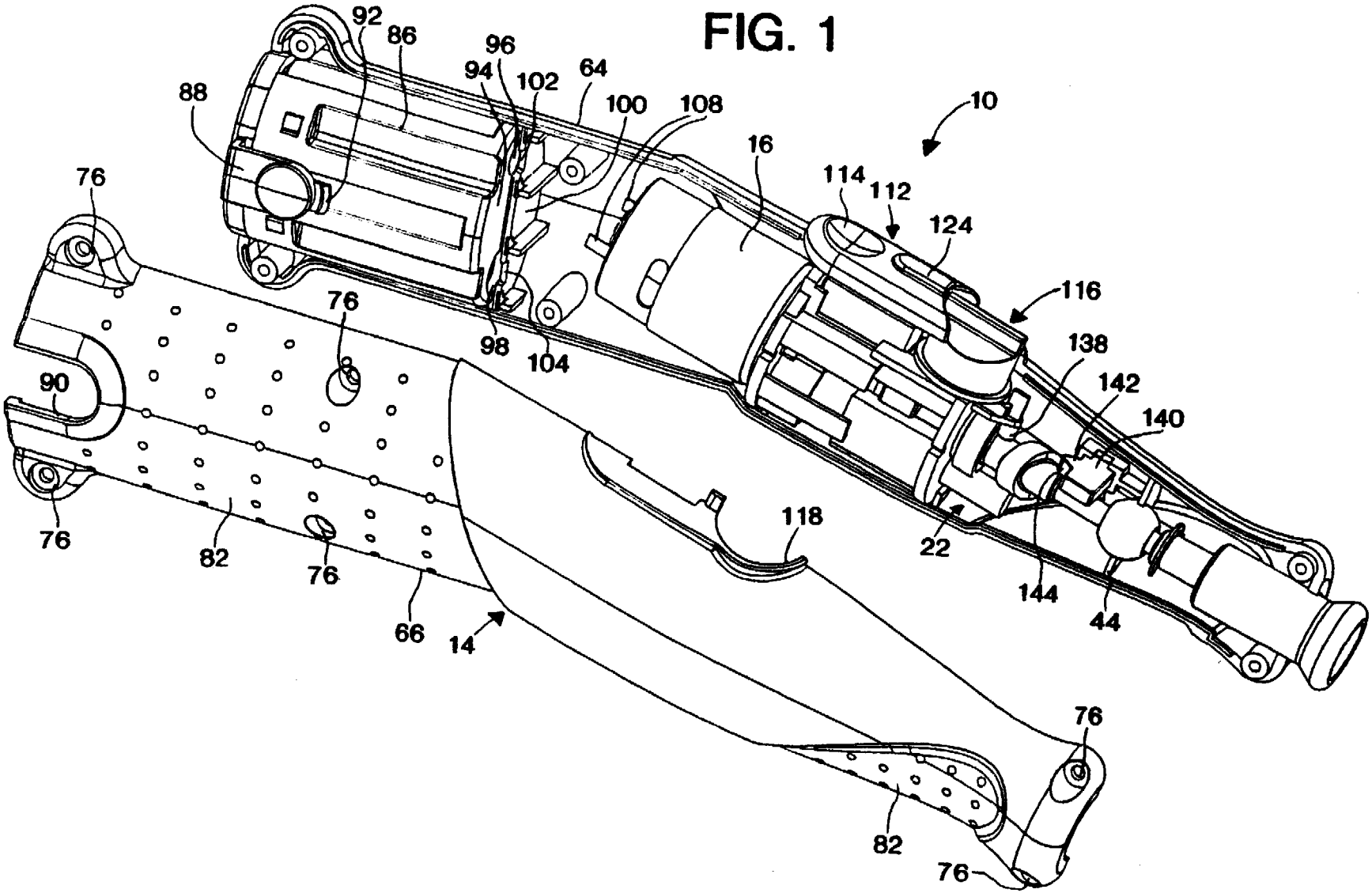
FIG. 1 is a perspective view of a power tool for cleaning and buffing according to the present invention illustrating a battery pack inserted in the rear housing portion for powering a motor to drive a transmission system contained in the front housing portion.
Figure 2:
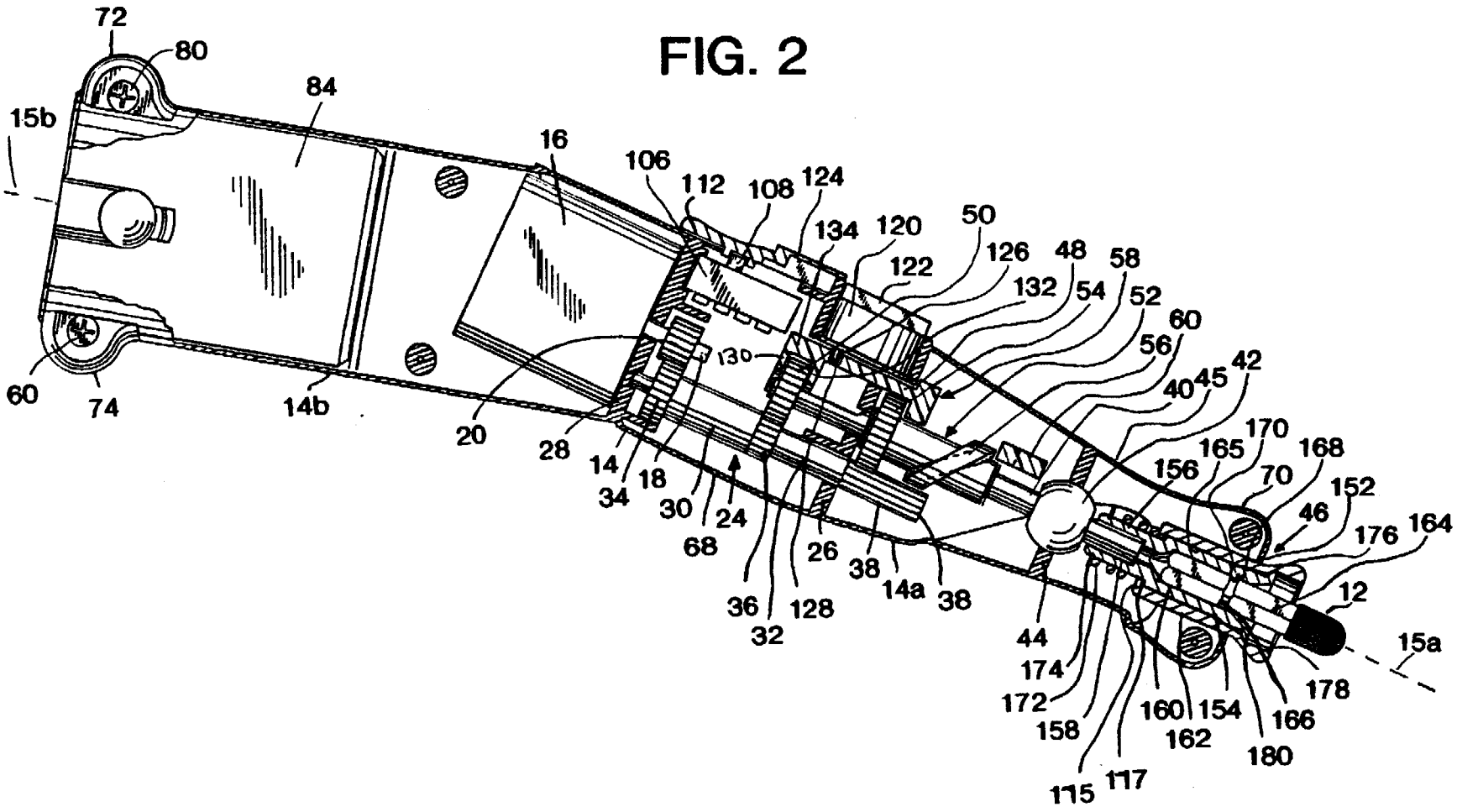
FIG. 2 is a sectional view of the power tool of FIG. 1 showing the details of the transmission system with a switch in its motor "off" position.

FIGS. 1 and 2 illustrate a hand-held power tool 10 according to the present invention, having a working element 12 capable of rotating or reciprocating for cleaning and buffing surfaces. The hand-held power tool or detailer 10 includes a housing 14 which preferably has an angled or bent design to enable an operator to more easily manipulate the detailer 10 to access and clean surfaces which would otherwise be difficult to access and/or clean. The housing 14 has a front housing potion 14*a* and a rear housing portion 14*b* each having a longitudinal axis 15*a* and 15*b*, respectively, extending therein with the axes 15*a* and 15*b* intersecting each other to define an included obtuse angle therebetween preferably of approximately 165°.

The housing 14 contains an electrically powered motor 16 for producing rotary input power through its primary drive shaft 18 and associated driving gear 20. A transmission system, generally designated 22, transmits the rotary input power generated by the motor 16 to either rotary or reciprocating motion of the working element 12 through its shafting and gear train. Thus, the cleaning element 12, which can take on a wide variety of forms such as brush-type and pad-type cleaning elements, can be rotated or reciprocated, depending on the action required for cleaning or buffing a surface, such as on cars or in homes or even on silverware. So, for example, where a surface has a portion on which a circular pad-type cleaning element can be positioned, an operator can choose the rotary mode of operation to clean such a surface, utilizing the pad-type cleaning element. Where the surface is such that a circular pad-type element cannot be oriented thereon, the reciprocating mode may be best utilizing a brush-type cleaning element for cleaning such a surface. The reciprocating mode may also be desirable for cleaning surfaces around small pockets and apertures, such as around the baffles of vents in car interiors. It is also possible that such surfaces can be effectively cleaned using either one or both of the rotating or reciprocating modes and using a variety of different types of cleaning elements as an operator can experiment using both modes and various cleaning elements to determine for themselves which combination is best, depending upon the exact surface configuration, orientation of the tool, and nature of the cleaning action required to clean the dirt buildup thereon. As is apparent from the above, the provision of both a rotating and reciprocating working element 12, gives an operator greater flexibility by providing the operator an option between these two cleaning actions for use on a surface to be cleaned.

More specifically referring to FIG. 2, the transmission system 22 includes a secondary shaft 24 extending between and supported by a forward frame member 26 and a rearward frame member 28 in front housing portion 14*a*, and journaled for rotation in apertures in the respective frames members 26 and 28. The secondary shaft 24 has an enlarged diameter section 30 and a reduced diameter section 32 with the enlarged section 30 having a driven gear 34 meshed with the primary shaft driving gear 20 for driving rotation of the secondary shaft 24 when the motor 16 is in its operative running state.

The secondary shaft 24 also has first and second driving gears 36 and 38, respectively thereon for transmitting the rotary input power generated by the motor to an output shaft 40. The first driving gear 36 is disposed on the secondary shaft enlarged section 30 at the juncture with the reduced section 32, and the second driving gear is formed at the forward end of the reduced section 32 adjacent to and forwardly of the frame member 28.

The output shaft 40 extends along the longitudinal axis 15*a* of the front housing 14*a*, and is supported for rotation in front frame member 26.The output shaft 40 extends through a spherical bearing 42 mounted in a transverse bearing support wall 44 spaced forwardly of forward frame member 26 in a neck-down section 45 of the front housing portion 14*a*. The output shaft 40 is operatively connected to the working element 12 through a mechanism 46 for removably securing working elements thereto which will be more fully described hereafter.

An actuator 48 is provided for cooperating with a driven gear 50 and a wobble driver 52 on the output shaft 40. The output shaft driven gear 50 can be moved along the output shaft 40 by the actuator 48 into position along the axis 15*a* where the gear 50 engages the first driving gear 36 on the secondary shaft 24 so as to transmit rotary motion from the secondary shaft 24 to the output shaft 40 and therefore the working element 12.

To cause the wobble driver 52 to reciprocate and drive the output shaft 40 for reciprocation, the wobble driver 52 has a driven gear portion 54 formed at its rearward end and an inclined cam member 56 formed at its forward end. With the actuator 48 moved so as to move the driven gear 50 on the output shaft 40 out of engagement with the secondary shaft driving gear 36, a forward portion 58 on the actuator 48 is moved from adjacent the wobble driven gear portion 54 to adjacent a cam engaging portion 60 mounted in the housing. In this position, the actuator forward portion 58 and the housing cam engaging portion 60 cooperate to define a guideway track or channel 62 through which the cam member 56 is rotated as the wobble driver 52 is rotated by the engagement of the second driving gear 38 and the driven gear portion 54. Such rotary travel of the cam member 56 through the guideway channel 62 causes the wobble driver 52 to reciprocate along the longitudinal axis 15*a*, as illustrated in FIGS. 5–8.

Returning to FIGS. 1 and 2, the details of construction of a preferred form of the detailer 10 will be more specifically described. As seen in FIG. 1, the bent housing 14 is formed from housing halves 64 and 66, each having substantially identical cross-sectional configurations along their length so that when they are connected the rear housing portion 14*b* has a substantially constant diameter, cylindrical configuration. The front housing portion 14*a* has a constant diameter, cylindrical rear section 68 leading to the neck-down section 45 which terminates in a flared forward end 70 where the working element mounting mechanism 46 is located.

To attach the housing halves 64 and 66, a pair of opposing dogears 72 and 74 are formed at the rearward end of the rear housing portion 14*b*. The housing half 66 has countersunk recessed apertures 76 formed in the dogears 72 and 74. Another pair of recessed apertures 76 are also provided on the rear housing portion 14*b* as well as at the forward end of the flared section 70 in the housing half 66. Correspondingly, a pair of threaded bosses 78 are formed in the dogears 72 and 74 on the housing half 64 and a pair of bosses 78 are also provided on the rear housing portion **14*b* as well as at the forward end of the flared section 70 on the housing half 64. Thus, with the housing halves 64 and 66 brought together, the countersunk recesses 76 can be aligned with the threaded bosses 78 such that fasteners 80 received in the apertures 76 can be received in the bosses 78 to secure the housing halves 64 and 66** to each other.

To allow an operator to easily grip and maneuver the detailer 10, the rear housing portion **14*b* has a dimpled, grippable material 82 applied thereon, such as rubber or leather material. Thus, in addition to being grippable in a full body position as near the juncture of the rear housing portion 14b and front housing portion 14*a* where the controls for the detailer are located, the user can grip the detailer 10 from the rear housing portion 14*b* exclusively so as to effectively extend the reach of the detailer 10** where the surface to be cleaned would otherwise be difficult to access and reach such as with a shorter tool.

In addition, a portion of the surface of the neck-down section 45 can be provided with the same dimpled grippable material 82 to allow an operator to exert greater control over the detailer 10 as with a pencil grip where the index finger is applied to the smooth, curved flared section 70 and the knuckle of the middle finger as applied against the grippable material 82. Where the operator has no problem orienting their hand close to the surface to be cleaned, the ability to control the detailer with a pencil-grip provides an improved ability to accurately guide the working element as it engages the surface to be cleaned.

To provide power for the electric motor 16, a battery pack 84 can be mounted in the housing rear portion **14*b*. While various arrangements can be utilized to mount the battery pack 84 in the housing 14, in the preferred and illustrated form, the battery pack 84 is provided with a housing 86 having locking tabs 88 extending on either side thereof. The housing halves 64 and 66 both include a U-shaped cut-out 90 at their rearward end to guide and receive the locking tabs 88 therein. A resilient flange member 90 can be mounted on the ends of the locking tabs 88 so that when the locking tabs 88 are inserted to the end of the U-shaped cut-outs 90, the resilient tabs 92 will snap-fit the battery pack 84 into the rear housing portion 14*b* so as to removably maintain the battery pack 84** therein.

The battery pack housing 86 is designed to permanently accommodate four "AA" cell batteries connected in series therein. The battery pack housing 86 has a forward end wall 94 having apertures 96 and 98 formed therein to allow the battery terminals to be arranged so that the terminals at the beginning and the end of the series are located at the apertures 96 and 98. With the battery pack 84 snap-fit in the rear housing portion **14*a*, the battery pack housing forward wall 94 can abut a battery pack support wall 100 having apertures 102 and 104 aligned with the apertures 96 and 98. The apertures 102 and 104 form cradles for contact tabs (not shown) which can engage the battery contacts and transmit battery power to the terminals 108 of the motor 16 and to the switching mechanism 106** through electric wiring (not shown), as is known.

The motor 16 preferably is a two-speed motor with the switching mechanism 106 associated with the motor to control its activation and speed. The switching mechanism 106 is mounted to the rear frame member 28 and has an activation lever 108 which is captured for movement in a well 110 formed on the underside of an exterior switch sheath 112. The switch sheath 112 has a dish-shaped depression 114 to readily accommodate the thumb of a user when pushing and pulling on the switch sheath 112 between its various positions. Preferably, the switch sheath has three positions and, as shown in FIG. 2, is in its rearmost position with the activation lever 108 positioned accordingly and the motor 16 in its deenergized "off" state. The switch sheath 112 can then be pushed forwardly to energize the motor in its "on" state at two positions, one being in an intermediate position at a low speed and the other forwardly thereof at a high speed. To turn the motor off, the switch sheath 112 is simply pulled back to its rearward position, as illustrated in both FIGS. 2 and 4.

A control 116 is mounted in an opening 118 formed at the top of the front housing portion **14*a* adjacent to and forwardly of the switch sheath 112 when in its rear "off" position. The control 116 has a circular portion 120 contained within the front housing portion 14*a* and an elongate grippable portion 122, which extends across the top of the circular portion 120 through its center and upwardly therefrom exteriorly of housing portion 14*a*. The control 116 is operable to shift the transmission system 122 so as transmit the rotary input power generated by the motor 16 to one of either rotary or reciprocating motion of the output shaft 40**.

Figure 3:
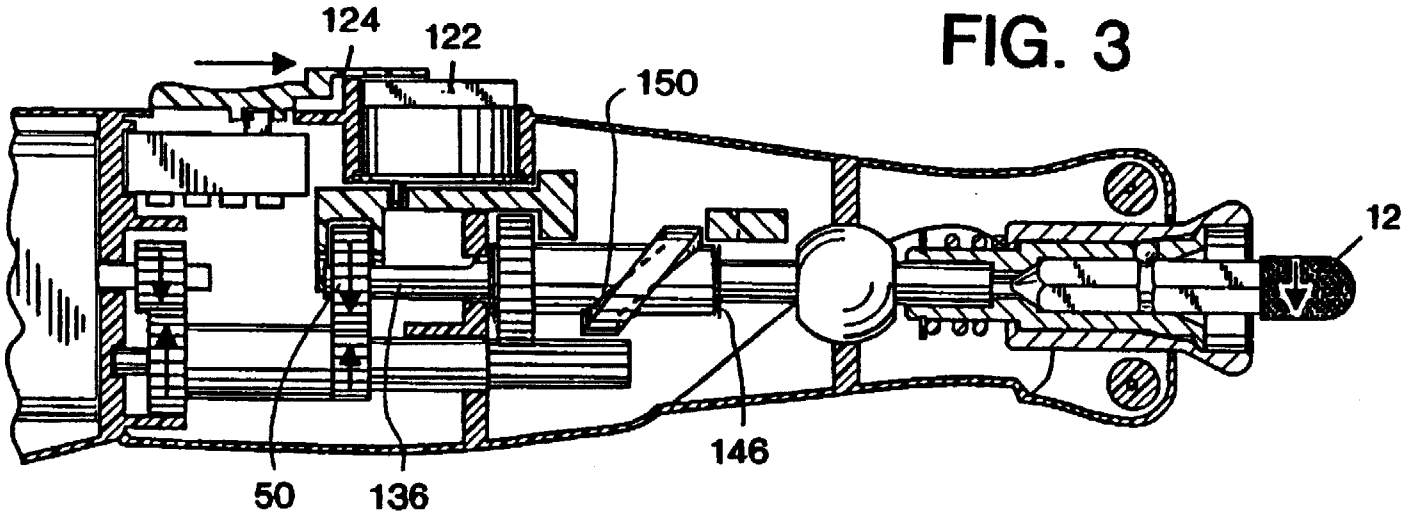
FIG. 3 is a sectional view of the front housing as shown in FIG. 1, showing the switch moved to its motor "on" position with the power tool in its rotary mode of operation.
Figure 4:
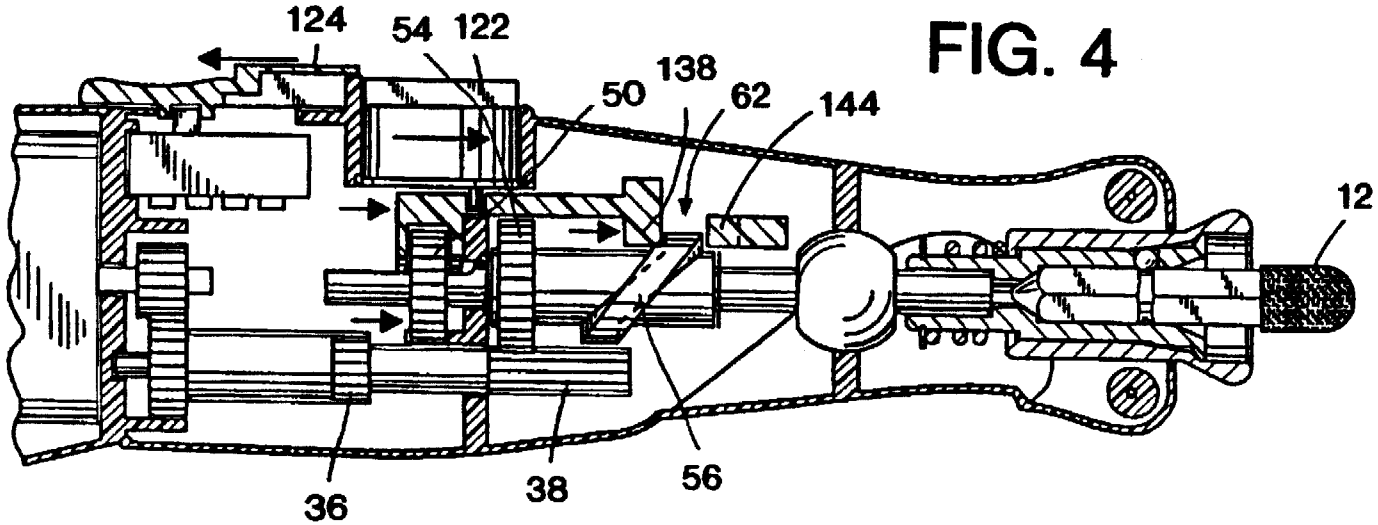
FIG. 4 is a sectional view similar to FIG. 2 showing the switch moved to its motor "off" position and a control for a transmission actuator turned to move the actuator with the tool in its reciprocating mode of operation.
Figure 5:
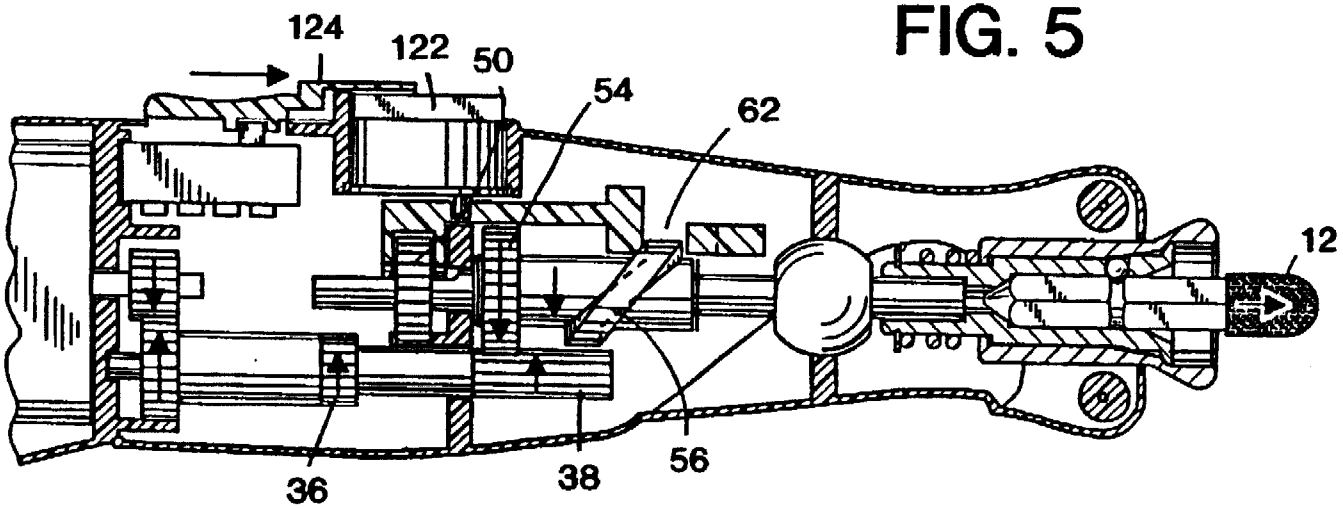
FIG. 5 is a sectional view similar to FIG. 3 showing the switch moved to its motor "on" position with the tool in the reciprocating mode of operation and a cam member rotating in a guideway channel.
Figure 6:
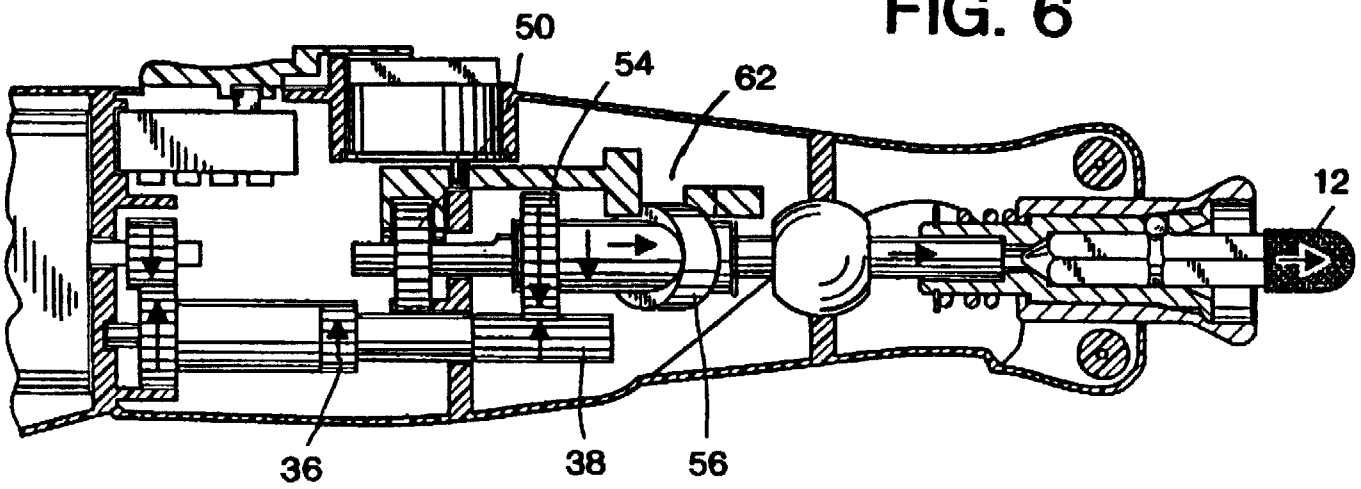
FIG. 6 is a sectional view similar to FIG. 3 showing the cam member rotated 90° from its FIG. 5 position.
Figure 7:
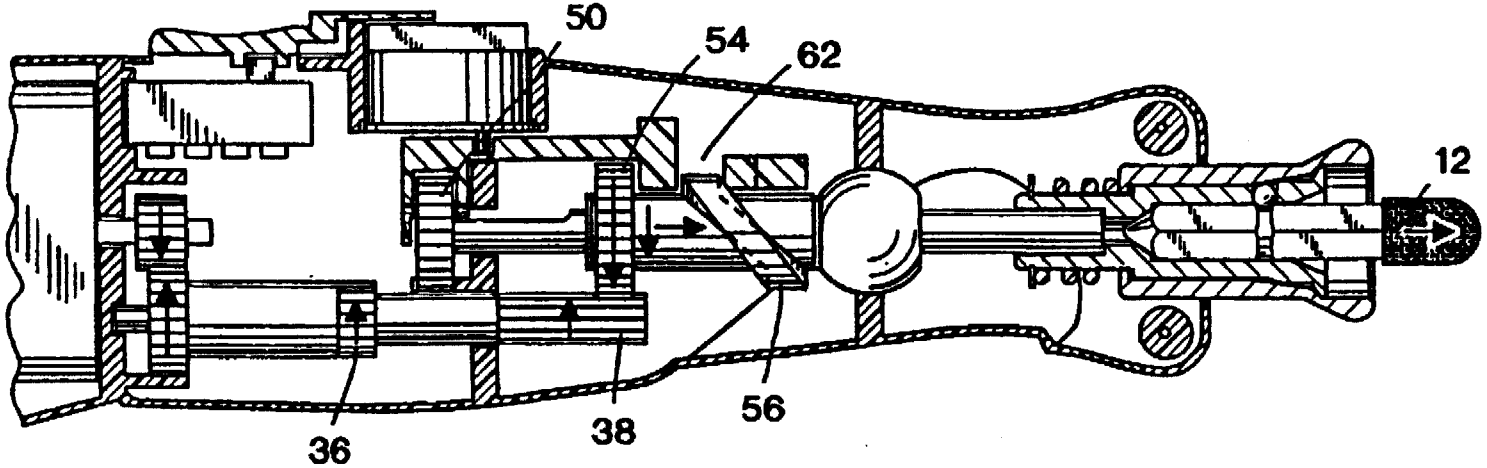
FIG. 7 is a sectional view similar to FIG. 3 showing the cam member rotated 180° from its FIG. 5 position.
Figure 8:
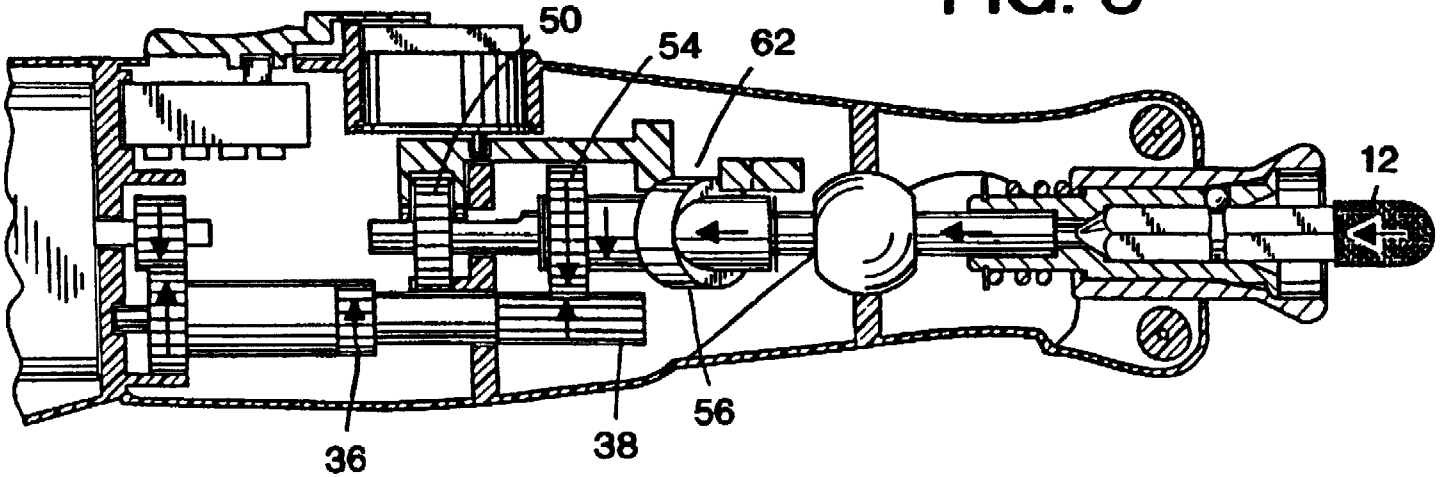
FIG. 8 is a sectional view similar to FIG. 3 showing the cam member rotated 270° from its FIG. 5 position.

The control 116 has its grippable portion 122 in alignment with an elongate raised seat 124 formed on the top of the sheath 112. With the switch sheath 112 in its rearward "off" position, the control grippable portion 122 is freely accessible so as to allow a user to operate the control 116 to choose one of the reciprocating or rotating modes of operation for the detailer 10. With the switch sheath 112 moved forwardly to energize the motor 116 in its "on" state with the motor 16 operating at either one of its two speeds, the grippable portion 122 is at least partially contained within the elongate raised seat 124 and is thereby prevented from being rotated to change the detailer 10 to the other of its rotating and reciprocating modes of operation. The only way a user can shift the detailer 10 from one of its rotating and reciprocating modes of operation to the other mode of operation is by first turning off the motor and then turning the control 116, which is illustrated in FIGS. 3–5, as the switch sheath 112 is moved forwardly to turn the motor "on" with the actuator 118 in its rearward position and the detailer in its rotary mode of operation. To shift the detailer to its reciprocating mode of operation, the switch sheath 112 is pulled back to turn the motor 16 off and expose the control grippable portion 122 from the switch seat 124 and the control portion 122 is turned through 180° to shift the actuator 48 to its forward position, as shown in FIG. 4. The switch sheath 112 is then pushed forwardly back to its motor "on" position with the seat 124 capturing the grippable portion 122 therein to prevent access thereto with the detailer in its reciprocating mode of operation. In this manner, the switch sheath 112 and control 116 interlock to avoid introducing shock loads into the transmission system and stripping gear teeth which could otherwise take place if the control 116 were to be operated while the motor 16 was running in one of its rotary or reciprocating modes of operation.

The control circular portion 120 has a small post 126 extending eccentrically from its bottom face into a slot 128 formed on the upper side of the actuator 48. By virtue of its off center location on the control circular portion 120, the post 126 moves the actuator between its rearward and forward positions as illustrated in FIGS. 2 and 4, respectively, as the grippable portion 122 is rotated 180° causing the post 126 to engage the surfaces of the slot 128 and move the actuator 48 between its rearward position (FIG. 2) and forward position (FIG. 4) in the front housing portion 14*a*.

The actuator 48 is preferably in the form of a forkshift actuator 48 and has two downwardly extending prongs 130 and 132 which define a gear capturing portion 134 of the forkshift actuator 48. The gear capturing portion 134 captures the output shaft driven gear 50 therein for movement with the forkshift actuator 48 as it is shifted between its rearward and forward positions. The output shaft 40 has a D-shaped rear portion 136 on which the output shaft driven gear 50 is mounted for sliding translation therealong as the actuator forkshift 48 is moved.

The actuator forward portion 58 is in the form of a downwardly extending circular boss 138 at the forward end of the forkshift actuator 48. The cam engaging portion 60 in the front housing portion 14*a* is preferably in the form of a rectangular piece 140 mounted to the front housing portion 14*a* and having a projection 142 having sloped cam engaging surfaces 144 thereon.

As previously mentioned, the second driving gear 38 on the secondary shaft 24 drives the wobble driven gear portion 54 so that the wobble driver 52 rotates about the output shaft 40. The wobble driver 52 is mounted on the output shaft 40 so as to freely rotate therearound, but is fixed axially with respect to the output shaft 40 by a retaining clip 146 mounted adjacent the forward end of the driver 52 on the output shaft 40. The wobble driver 52 is restricted for movement in a rearward direction by the front frame member 26. The second driving gear 38 on the secondary shaft 24 is an elongate gear along which the wobble driven gear portion 54 can reciprocate. Thus, with the forkshift actuator 48 in its rearward position, as illustrated in FIG. 2, the forkshift actuator gear capturing portion 134 will position the output shaft driven gear 50 in engagement with the secondary shaft first driving gear 36 and the forward circular boss 138 will be positioned adjacent to the wobble driven gear portion 54. With this arrangement, the rotary input power generated by the motor 16 will be transmitted through meshing of the gears 36 and 50 to the output shaft 40 with the wobble driver 52 freely rotating about the output shaft 40 due to engagement of the gears 38 and 54. However, the wobble driver 52 will freely rotate in a fixed axial position relative to the elongate gear 38 as the forward boss 138 on the forkshift actuator 48 will prevent the gear portion 54 from reciprocating along the gear 38 as by any action of the cam member 56 against the portion 60. When the forkshift actuator 48 is moved to its forward position as illustrated in FIG. 4, the gear capturing portion 134 will move the output shaft driven gear 50 forwardly along the D-shaped rear portion 136 of the shaft 40 so that it is no longer in engagement with the first driving gear 36 of the secondary 24. Simultaneously, the forward boss 138 will be moved forwardly towards the cam engaging projection 142 so as to form a channel 62 therebetween in which the cam member 56 is rotated as the wobble driver 52 is driven for rotation about the output shaft 40 by engagement of the elongated second driving gear 38 and the wobble driven gear portion 54.

The cam member 56 is preferably provided with contoured surfaces 150 on either side thereof to engage both the rounded surface of the circular boss 138 and the sloped surfaces of the projection 142 as the cam member 56 is rotated in the channel 62. In this manner, the cam member moves smoothly against the surfaces of the boss 138 and the projection 142 and, accordingly, smoothly reciprocates the wobble driver 52 and, therefore, the output shaft 40, along the longitudinal axis 15*a* as the cam member 56 changes orientation with respect to the longitudinal axis 15*a*. FIGS. 5–8 illustrate the detailer 10 in its reciprocating mode of operation with the forkshift actuator 48 in its forward position such that the gears 36 and 50 are disengaged and the cam member 56 rotates in the channel 62 with the wobble driven gear portion 54 rotating the wobble driver 52 and reciprocating along the length of the second driving gear 38. Each of these Figures show the cam member 56 rotated 90° further from the Figure immediately preceding it so as to illustrate the working element 12 reciprocating through one complete stroke which can be gleaned from the progressively different positions of the wobble driven gear portion 54 along the length of the second driving gear 38 as the driver 52 is axially reciprocated. By substantially rigidly forming the channel between the forward boss 138 on the forkshift actuator 48 and the fixed projection on the rectangular piece 140, the detailer 10 is provided with a smooth and sturdy reciprocating action which will remain fairly constant over a relatively long period of time.

Turning to the working element mounting member 46 and referring to FIG. 2, the mounting mechanism 46 includes a collet 152 having an inner sleeve 154 mounted therein. The inner sleeve 154 has a back end 156 extending outwardly from the collet 152 which has a bore sized to frictionally mount the forward end 158 of the output shaft 40 therein. The inner sleeve 154 has an enlarged diameter section 160 which has its outer surface in sliding engagement with the inner surface of the main annular portion 162 of the collet 152.

Although the working element 12 can come in other forms, such as pad-type and brush-type working elements, the illustrated form is a buffing-type working element 12. Preferably, the working elements 12 should be mounted on a pilot shaft 164 having a hexagonal cross sectional shape to correspond to the hexagonal shape of the longitudinal bore 165 defined by the enlarged diameter section 160 of the inner sleeve 154. The pilot shaft 164 has a circumferential groove 166 formed therein preferably about midway along its length. The inner sleeve 154 has a radial bore 168 extending therethrough sized to receive a detent ball 170 therein. The radial bore 168 has an opening at the inner surface of the inner sleeve 154 slightly smaller than the diameter of the detent ball 170 so as to allow the detent ball 170 to project slightly into the bore 165 of the inner sleeve 154.

The collet 152 is spring loaded to a position exterior of the front housing portion 14*a* by a spring member 172 mounted between a lock clip 174 mounted at the rear of the back end 156 of the inner sleeve 154 and the shoulder 175 of the collet 152 with the shoulder 175 abutting the shoulder 177 formed between the reduced back end section 156 and the enlarged diameter section 160 of the sleeve 154. With the pilot shaft 164 inserted all the way into the bore 165 of the inner sleeve 154, the circumferential groove 166 is aligned with the radial bore 168 of the sleeve 154 with the inner surface of the main annular portion 162 of the collet 152 pushing at least a portion of the detent ball 170 through the radial bore 168 and into the circumferential groove 166 to removably lock the shaft 164 in the inner sleeve bore 165.

The collet 152 has a flared section 176 formed at the forward end of the main annular portion 162 having a straight annular inner surface 178. The inner sleeve 154 has a forward circumferential lip 180 which extends radially to the inner surface 178. With the collet 152 biased to its predetermined extended position, the lip 180 engages the rear of the straight annular surface 178. To insert the pilot shaft 164 in the inner sleeve 154, the collet 152 is pushed against the bias of spring member 172 so that the lip 180 slides to the front of the straight annular surface 178, allowing the detent ball 170 to move into a pocket formed between the lip 180 and the straight annular surface 178. In this manner, the pilot shaft 164 can be inserted in the inner sleeve 154 with the collet 152 then being released so that the inner surface of the main annular portion 162 pushes the detent ball 170 through the radial bore 168 into the groove 166 to lock the shaft 164 in the inner sleeve bore 165. Similarly, to remove the pilot shaft 164, such as for changing working elements 12, the collet 152 is pushed against the spring bias to once again release the detent ball 170 into the pocket formed between the annular surface 178 and the lip 180 to thereby allow the shaft 164 to be released from the inner sleeve bore 165.

While there have been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

I claim:

1. A power tool having a working element capable of rotating or reciprocating, the power tool comprising:

a housing having a first longitudinal axis extending therein;

an output shaft mounted in the housing along the longitudinal axis operatively connected to the working element;

a motor in the housing for driving the output shaft;

a transmission system having cooperating portions thereof which are movable between (1) a first state wherein the cooperating portions are disengaged from each other allowing the output shaft to reciprocate, and (2) a second state wherein the cooperating portions are engaged with each other causing the output shaft to rotate;

a wobble driver mounted to the output shaft with the wobble driver having (1) a first mode wherein the wobble driver is in driving relation to the output shaft and is capable of driving the output shaft for reciprocation therewith along the first longitudinal axis, and (2) a second mode wherein the wobble driver is in non-driving relation to the output shaft; and an actuator which cooperates with the wobble driver and one of the transmission system cooperating portions and is selectively movable between (1) a first position wherein the transmission system cooperating portions are in their first disengaged state and the wobble driver is in its first driving mode relative to the output shaft with the wobble driver driving the output shaft for reciprocation therewith along the first longitudinal axis to reciprocate the working element, and (2) a second position wherein the transmission system cooperating portions are in their second engaged state and the wobble driver is in its second non-driving mode relative to the output shaft with the output shaft rotating to rotate the working element.

2. The power tool of claim 1 wherein the wobble driver is mounted to the output shaft to be independently rotatable relative thereto and the wobble driver includes a driven gear for causing the wobble driver to freely rotate about the output shaft and a cam member inclined relative to the first longitudinal axis, and the housing and actuator have portions which cooperate to form a channel for the cam member with the actuator in its first position to cause the wobble driver to reciprocate as the cam member is rotated in the channel and engages the housing and actuator portions.

3. The power tool of claim 2 wherein the transmission system includes a secondary drive shaft in the housing driven by the motor including an elongate second driving gear thereon which drives the wobble driven gear causing the wobble driver to freely rotate about the output shaft, the wobble driven gear reciprocating along the elongate second driving gear with the actuator in its first position and being retained in a substantially fixed axial position relative to the elongate second driving gear by the actuator portion with the actuator in its second position so as to only rotate about the output shaft in the fixed axial position.

4. The power tool of claim 2 wherein the wobble cam member has contoured surfaces for rolling contact along the housing and actuator portions with the actuator in its first position.

5. The power tool of claim 1 wherein the housing includes a control for the actuator and a switch selectively movable between an "on" position with the motor energized to drive the output shaft and an "off" position with the motor deenergized, the switch locking the control to maintain the actuator in one of its first and second positions when the switch in the "on" position.

6. The power tool of claim 1 wherein the transmission system includes a secondary drive shaft in the housing driven by the motor and the one transmission cooperating portion is a driven gear on the output shaft and the other transmission cooperating portion is a first driving gear on the secondary drive shaft.

7. The power tool of claim 6 wherein the output shaft driven gear is slidably mounted on the output shaft and the actuator has a gear capturing portion which captures the output shaft driven gear for sliding movement along the output shaft as the actuator is moved from one of its first and second positions to the other of its first and second positions.

8. The power tool of claim 1 wherein the wobble driver includes a driven gear and the transmission system includes a secondary drive shaft in the housing driven by the motor and including an elongate second driving gear thereon having a length and which drives the wobble driven gear causing the wobble driven gear to reciprocate along the length of the second driving gear with the actuator in its first position.

9. The power tool of claim 1 wherein the housing has a forward portion through which the first longitudinal axis extends and containing the transmission system, and a rearward grippable portion having a second longitudinal axis extending therethrough with the first longitudinal axis intersecting the second longitudinal axis to define an included obtuse angle therebetween.

10. The power tool of claim 9 wherein the forward portion includes a grippable surface thereon so as to provide the power tool with a pencil grip to allow an operator to control the power tool thereat during tool operation.

11. The power tool of claim 9 wherein the rearward portion includes a battery pack removably mounted therein for supplying power to the motor.

12. The power tool of claim 1 in combination with a pilot shaft mounting the working element and having a circumferential groove formed therein and further including a collet formed by a main annular portion and a forward flared portion and having an inner sleeve therein mounting the output shaft and removably mounting the grooved pilot shaft and having a radial bore aligned with the pilot shaft groove when the pilot shaft is secured in the sleeve with the collet main annular portion being sized to be slidable along the inner sleeve, and a detent ball is disposed between the collet and sleeve, the collet being spring biased to a predetermined position outside the housing with the collet annular portion pushing the detent ball to extend at least partially through the radial bore and into the circumferential groove to secure the pilot shaft in the sleeve.

13. The power tool of claim 12 wherein the collet can be pushed against the spring bias from the predetermined position towards the housing to move the collet flared portion sufficiently rearwardly into alignment with the radial bore allowing the detent ball to move out of the circumferential groove into a pocket formed between the sleeve forward end and the collet flared portion and to thereby allow the pilot shaft to be removed from the sleeve.

14. A power tool having a working element capable of rotating or reciprocating, the power tool comprising:

a housing having a forward end and defining a longitudinal axis extending therein;

an output shaft operatively connected to the working element at the housing forward end;

a motor producing rotary input power to drive the output shaft for one of rotation and reciprocation;

a wobble driver mounted on the output shaft in a fixed axial position relative thereto to drive the shaft for reciprocation therewith and to freely rotate relative thereto and including a rear driven gear to freely rotate the wobble driver about the output shaft and a forward cam member inclined relative to the longitudinal axis to convert the rotation of the wobble driver about the output shaft to reciprocation of the wobble driver which drives the output shaft therewith along the longitudinal axis;

an actuator cooperating with the wobble driver to cause the rotary input power of the motor to one of (1) drive the output shaft for rotation to rotate the working element, and (2) drive the wobble driver for reciprocation with the output shaft along the longitudinal axis to reciprocate the working element; and a cam engaging portion mounted in the housing and an actuator portion with the portions being selectively movable relative to each other between (1) a first position adjacent to each other to cooperate to form a channel such that the wobble cam member engages the portions as the wobble driver rotates causing the wobble driver and output shaft to reciprocate along the longitudinal axis, and (2) a second position spaced further from each other than when in their adjacent first position to position the actuator portion adjacent the rear driven gear preventing the wobble driver from reciprocating along the longitudinal axis.

15. The power tool of claim 14 wherein the actuator is selectively movable and the housing cam engaging portion is a flange member fixed to the housing with the actuator being selectively movable between (1) a forward position with the portions in their first adjacent position, and (2) a rearward position with the portions in their second spaced apart position.

16. The power tool of claim 15 wherein the output shaft includes a driven gear slidably mounted thereon and the actuator has a gear capturing portion which captures the output shaft driven gear for sliding movement along the output shaft as the actuator is moved from one of its forward and rearward positions to the other of its forward and rearward positions.

17. The power tool of claim 14 wherein the output shaft and the wobble driver are both driven for independent rotation relative to each other by the motor rotary input power with the actuator in its second position.

18. The power tool of claim 14 wherein the motor has a primary drive shaft and the motor input rotary power is transmitted to the output shaft by a secondary shaft geared to the primary drive shaft, the secondary shaft including first and second driving gears with the first gear being selectively movable into and out of driving relation relative to the output shaft and the second driving gear driving the wobble rear driven gear to rotate the wobble driver about the output shaft when the first gear is both in driving relation with the output shaft and out of driving relation with the output shaft.

19. The power tool of claim 18 wherein the output shaft has a driven gear slidably mounted thereon and the actuator slides the output shaft driven gear along the longitudinal axis as it is moved between its first and second positions so that with the actuator in its first position the output shaft driven gear is disengaged from the secondary shaft first driving gear and with the actuator in its second position the output shaft driven gear is engaged with the secondary shaft first driving gear to rotate the output shaft.

20. A power tool selectively movable between a rotary mode of operation and a reciprocating mode of operation, the power tool comprising:

an output shaft for driving the working tool to rotate or reciprocate;

an elongate housing having a longitudinal axis extending therein along which the output shaft extends;

a motor having a primary drive shaft and a driving gear on the drive shaft;

a secondary shaft mounted in the housing and having a plurality of gears with a first one of the secondary shaft gears cooperating with the primary shaft driving gear for rotary driving of the secondary shaft;

a wobble driver having a collar portion and a gear portion, the wobble driver being mounted on the output shaft to freely rotate therearound and to drive the output shaft along the longitudinal axis;

a driven gear mounted on the output shaft and being selectively movable on the shaft along the longitudinal axis to (1) an engaged position where the driven gear cooperates with a second one of the secondary shaft gears for driving the output shaft for rotation with the power tool in a rotary mode of operation, and (2) a disengaged position where a third one of the secondary shaft gears cooperates with the wobble gear portion to drive the output shaft for reciprocation with the power tool in a reciprocating mode of operation, the third secondary shaft gear causing rotation of the collar about the output shaft with the driven gear in either one of the engaged and disengaged positions; and an actuating mechanism to selectively allow an operator to change the power tool from one of the rotary and reciprocating modes of operation to the other of the rotary and reciprocating modes of operation.

21. The power tool of claim 20 wherein the actuating mechanism includes a control mounted on the housing and an actuator mounted in the housing to cooperate with the output shaft driven gear with the control selectively moving the actuator to move the driven gear between its engaged and disengaged positions.

22. The power tool of claim 21 wherein the actuator has a rear gear capturing portion to capture the output shaft driven gear for movement therewith and a forward boss which is positioned adjacent the wobble gear portion with the output shaft driven gear in its engaged position and adjacent the cam member with the output shaft driven gear in its disengaged position.

23. A power tool having a working element for cleaning and buffing, the power tool comprising:

a housing defining a longitudinal axis therein;

a motor for producing rotary input power to drive the working element;

an output shaft operatively connected to the working element and having a first state wherein the shaft and working element undergo a first motion and a second state wherein the shaft and working element undergo a second motion distinct from the first motion;

a transmission system between the motor and output shaft which transmits the rotary input power of the motor to the output shaft to drive the output shaft in either one of its first and second states;

a control mounted on the housing and selectively movable between first and second positions such that with the control in the first position the transmission system causes the output shaft to be driven in its first state and with the control in the second position the transmission system causes the output shaft to be driven in its second state; and a motor switch mounted on the housing selectively movable between an "off" position with the motor deenergized and an "on" position with the motor energized to drive the output shaft in one of its first and second states and with the switch in the "on" position the switch cooperates to lock the control in one of its first and second positions against selective movement to the other of its first and second positions.

24. The power tool of claim 23 wherein the output shaft undergoes reciprocating motion in its first state and rotating motion in its second state.

25. The power tool of claim 23 wherein the motor has a first low speed and a second high speed and the switch cooperates to lock the control with the motor being driven at either one of its first and second speeds.

26. The power tool of claim 23 wherein the switch and control are mounted adjacent each other on the housing and the switch includes a seat therein and the control includes a raised gripping portion thereof and with the switch in the motor "on" position the gripping portion is at least partially disposed in the switch seat to prevent movement of the control between its first and second positions.

27. The power tool of claim 26 wherein the control is a circular knob and with the switch in its motor "off" position the gripping portion can be turned through 180 degrees to rotate the knob for moving the control from one of its first and second positions to the other of its first and second positions such that in either the first and second positions, the gripping portion is aligned with the seat to allow the seat to be moved so that it captures the gripping portion therein when the switch is moved to its motor "on" position.

* * * * *